US006758710B2

(12) United States Patent
Brown et al.

(10) Patent No.: US 6,758,710 B2
(45) Date of Patent: Jul. 6, 2004

(54) METHOD OF REINFORCEMENT OF MARINE BUOYANCY MODULES

(75) Inventors: Gary Lee Brown, The Woodlands, TX (US); Ronald Northcutt, Houston, TX (US); Jeffrey Peck, Cleveland, TX (US)

(73) Assignee: CRP Balmoral Inc., Houston, TX (US)

( * ) Notice: Subject to any disclaimer, the term of this patent is extended or adjusted under 35 U.S.C. 154(b) by 0 days.

(21) Appl. No.: 10/187,293

(22) Filed: Jul. 2, 2002

(65) Prior Publication Data

US 2004/0005829 A1 Jan. 8, 2004

(51) Int. Cl.[7] ..... B63B 21/52
(52) U.S. Cl. ..... 441/133; 441/131
(58) Field of Search ..... 114/263, 264, 114/265, 266, 267; 428/378; 441/129, 131, 132, 133; 405/171

(56) References Cited

U.S. PATENT DOCUMENTS

| | | | | | |
|---|---|---|---|---|---|
| 2,934,790 | A | * | 5/1960 | Shwayder | 264/156 |
| 3,113,328 | A | * | 12/1963 | Muller | 441/133 |
| 3,705,432 | A | * | 12/1972 | Watkins, Jr. | 441/133 |
| 3,729,756 | A | * | 5/1973 | Cook et al. | 441/133 |
| 4,057,450 | A | | 11/1977 | Lee | 156/213 |
| 4,102,137 | A | | 7/1978 | Porraz et al. | 405/18 |
| 4,188,679 | A | * | 2/1980 | Hollaender et al. | 441/133 |
| 4,422,801 | A | * | 12/1983 | Hale et al. | 441/133 |
| 4,474,129 | A | | 10/1984 | Watkins et al. | 114/243 |
| 4,634,314 | A | | 1/1987 | Pierce | 405/224.2 |
| 4,764,137 | A | * | 8/1988 | Schulte | 441/133 |
| 4,858,881 | A | * | 8/1989 | Alloway | 249/135 |
| 5,292,578 | A | * | 3/1994 | Kolzer | 428/378 |
| 5,711,639 | A | * | 1/1998 | Tessier et al. | 441/133 |
| 6,155,748 | A | | 12/2000 | Allen et al. | 405/195.1 |
| 6,632,112 | B2 | * | 10/2003 | Nish et al. | 441/133 |

FOREIGN PATENT DOCUMENTS

| | | |
|---|---|---|
| EP | 0 090 394 A1 | 10/1983 |
| EP | 0628758 A1 | 12/1994 |
| FR | 1135926 | 5/1957 |
| GB | 1 433 704 | 4/1976 |
| WO | 0031169 | 6/2000 |
| WO | 03025331 | 3/2003 |

* cited by examiner

*Primary Examiner*—S. Joseph Morano
*Assistant Examiner*—Lars A. Olson
(74) *Attorney, Agent, or Firm*—Clark & Brody

(57) ABSTRACT

A marine buoyancy unit which fits at least partly around a marine object such as a riser with auxiliary conduits is composed of syntactic foam with an external layer or skin of harder polymeric composite. To reinforce the unit slots or channels are cut in the exterior of the unit or borings are created which extend within the unit and reinforcement in the form of webs or strips are placed into the slots or channels or borings. The reinforcement is embedded into the slots, channels or borings by introducing a curable resin.

29 Claims, 2 Drawing Sheets

METHOD OF REINFORCEMENT OF MARINE BUOYANCY MODULES

FIELD OF THE INVENTION

The present invention is concerned with units and modules used primarily to impart buoyancy to marine objects and secondarily to protect such objects.

BACKGROUND OF THE INVENTION

Known buoyancy modules are made of low-density syntactic foam with a skin or layer of harder polymeric composite. In harsh marine environments such units and modules tend to become damaged or to fracture from time to time.

An object of the invention is to provide a method of renovation upgrading and/or reinforcement for such units and modules.

SUMMARY OF THE INVENTION

According to one aspect of the invention there is provided a method of reinforcing a marine buoyancy unit designed to fit at least partially around a marine object; said method comprising cutting slots or channels in an exterior surface of the unit, placing reinforcement material in the channels and filling the channels with a curable resin to embed the reinforcement material into the channels.

In another aspect the invention provides a method of reinforcing a marine buoyancy unit designed to fit at least partially around a marine object; said method comprising producing borings extending within the unit, placing reinforcement in the borings and filing the borings with a curable resin to embed the reinforcement into the borings.

The unit may be of part-cylindrical, e.g. semi-cylindrical, shape with an exterior skin or layer of high strength polymeric composite and an interior formed of syntactic foam. The channels penetrate the skin and extend into the syntactic foam interior whereas the borings would extend through the syntactic foam closely adjacent the skin. A number of such units would be united to form a module surrounding part of the marine object. The channels or borings extend longitudinally of the unit. A glass fibre mat may be laminated onto the exterior after the channels or borings are filled.

The invention may be understood more readily, and various other features of the invention may become apparent, from consideration of the following description.

BRIEF DESCRIPTION OF THE DRAWINGS

An embodiment of invention will now be described, by way of example only, with reference to the accompanying drawing in which.

DETAILED DESCRIPTION OF THE INVENTION

Figure 1:
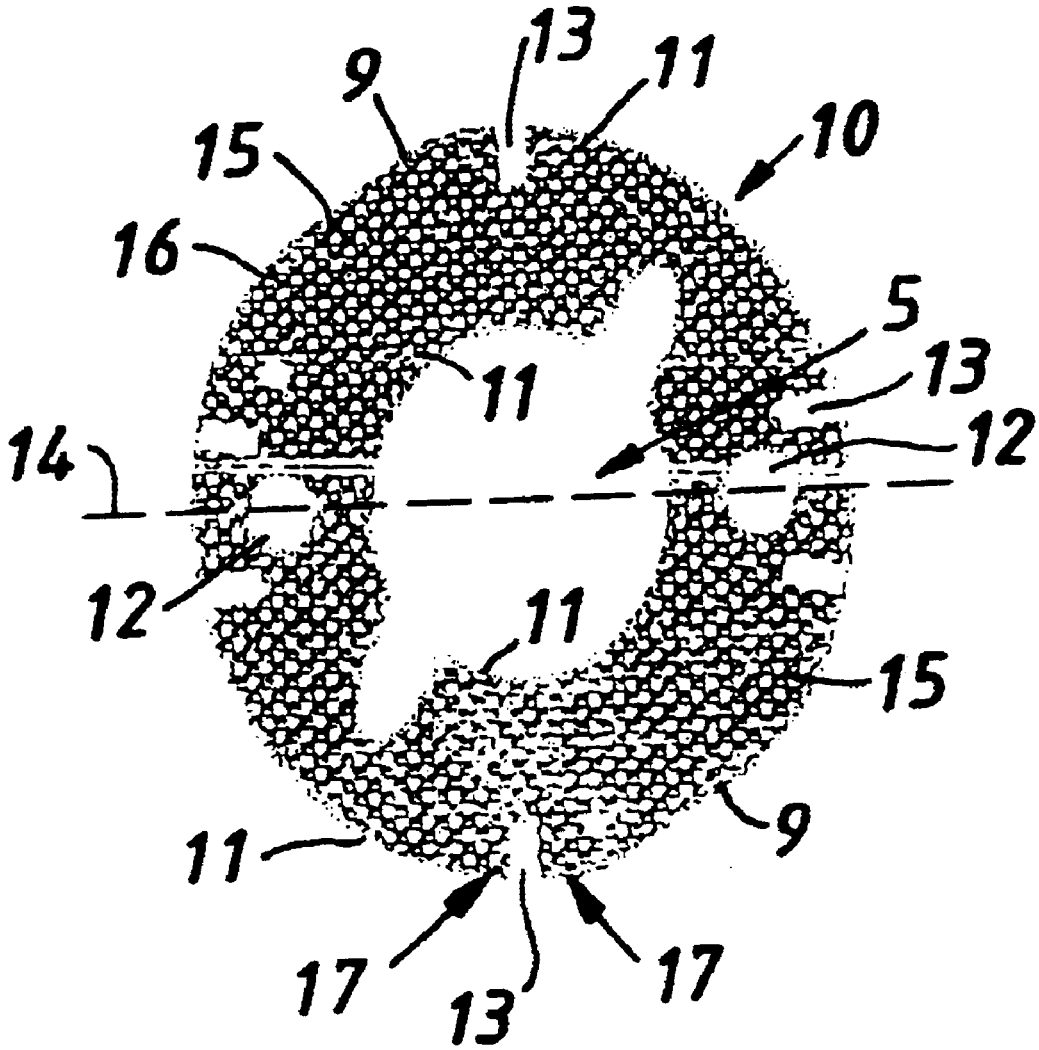
FIG. 1 is a cross-section of a buoyancy module at a preliminary stage in carrying out a method of reinforcement in accordance with the invention and FIG. 2 depicts part of a strip of reinforcement used in the method.

As shown in FIG. 1, a buoyancy module 10 is composed of two complementary units 9 each of semi-cylindrical form with a continuous outer layer 11. This is merely illustrative and there can be more than two units 9 making up the module 10. The interior main bodies 15 of the units 9 within the layers 11 is composed of syntactic foam. The units 9 are designed to fit around a marine object and part of the layers 11 define an internal cavity 5 shaped to conform with the marine object. By way of example the marine object can be a riser or pipeline with auxiliary conduits. Semi-circular recesses 12 in the diametric plane 14 separating the units 9 are designed to fit around a pair of such conduits. The units 9 can be held on the marine object by means of flexible bands or bolts but it is possible to provide an interlocking connection between the units 9. Normally a series of modules 10 each composed of a pair of the units 9 would be arranged end-to-end along the marine object and the ends of the modules 10.

At any time during their service life in a marine environment, the modules 10 and the units 9 may need to be renovated, upgraded and/or at least reinforced to prevent fracture or separation into parts following fracture. A method of such reinforcement, in accordance with the invention, will now be described. As shown in FIG. 1, a number of channels, here three, are made in the exterior of each of the units 9. Typically, the channels 13 are positioned at 10°, 90° and 170° from the diametric plane 14 in the anti-clockwise sense. Typically the width of each channel 13 is around one inch and the depth of each channel 13 is around two to two and a half inches. The depth of each channel 13 is such that the outer layer 11 is penetrated and the channel extends into the interior foam 15. Each channel 13 extends along the length of the unit 9 but terminates inwardly of the ends. Typically around one inch separates the ends of the units 9 from the ends of the channels 13. After the channels 13 have been produced any paint on the exterior peripheral surface 16 is removed in the vicinity of each channel 13 and the regions 17 of the surface 16 at the juncture with the channels 13 are buffed to provide a mechanical key. Any debris left from the cutting of the channels 13 and the other treatments is removed by brushing or by vacuum cleaning. The channels 13 are then filled with reinforcement such as strips 20 made of a polymeric fibre mesh.

Figure 2:
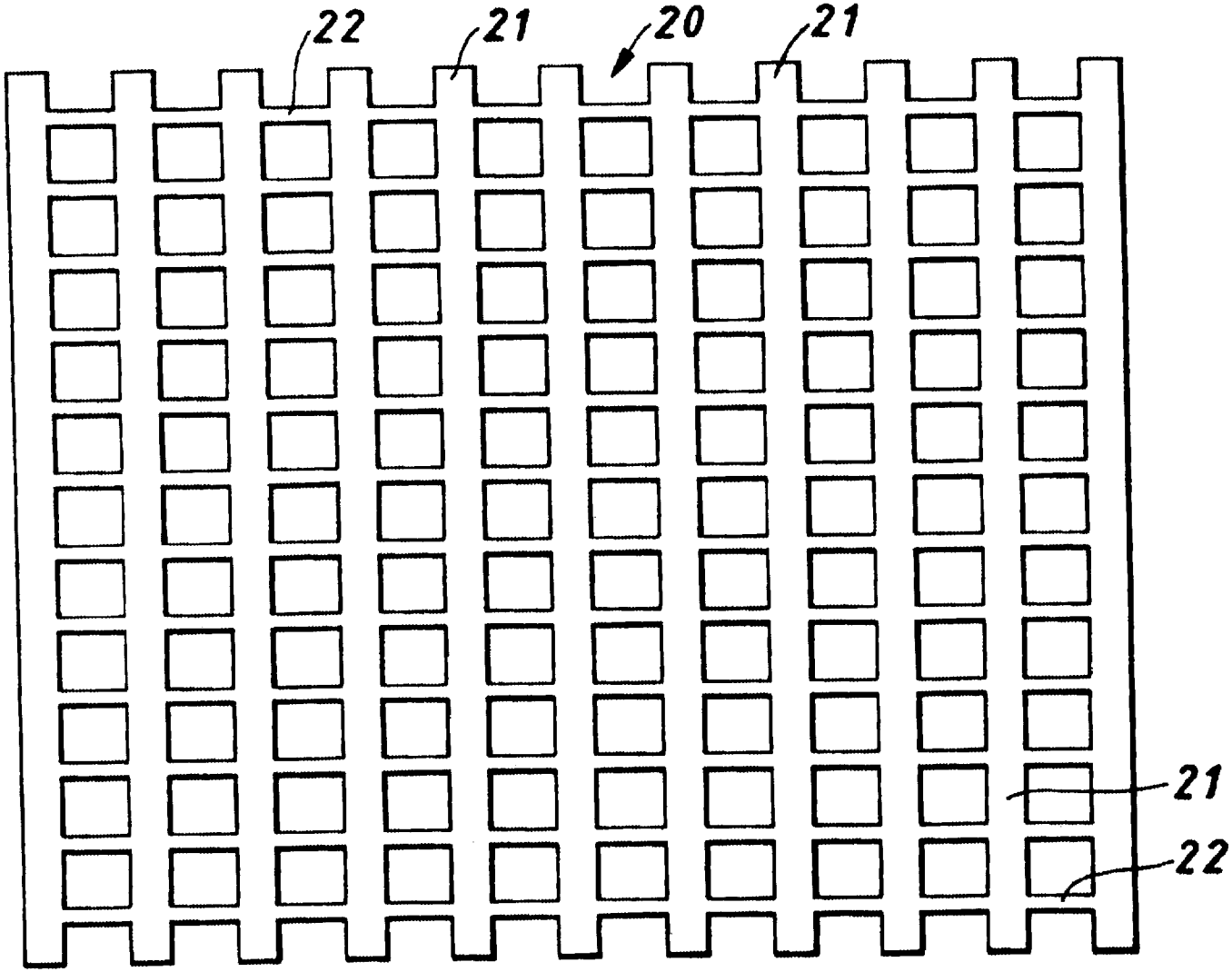

Part of one of the strips 20 are shown in FIG. 2. The strip 20 has warp bands 21 extending along its length and thinner weft bands 22 running in the transverse direction. As shown there are ten to twelve warp bands 21 over the width of the strip 20. The overall width of the strip 20 is greater than the width of the channels 13. For convenience, each strip 20 is bent and rolled into a tight cylinder held with tie wraps. After placing the rolled strips 20 in the channels 13, the tie wraps are released and removed. The next stage in the preferred method is to apply a glass fibre mat over the filled channels 13 and to introduce a resin mix which fills the channels 13 to embed the strips 20. Vents in the mat allow air to escape. The mat itself can be held in place with a pre-formed semi-rigid sheet which is removed once the resin has cured. After curing the exterior of the reinforced unit 9 is buffed or sanded and then painted.

The reinforcement need not be in the form of a mesh instead continuous webs or strips of reinforcement material can be used or individual polymeric fibres or strands can be used. In all cases the reinforcement is made from polymeric fibres or strands either separate or joined together. The number of channels 13 and their dimensions discussed above is suitable for the strips 20 of polymeric mesh fibre and the channels 13 may be adapted to suit other reinforcement materials. For example, single fibres or strands would need a channel depth of at least 15 mm. The most important characteristic is the tensile strength of the mesh reinforcement material. Ideally once the strips or other reinforcement 20 have been embedded in the channels 13 and the glass fibre mat has been bonded onto the exterior surface of the unit 9 the additional or supplementary tensile strength of the reinforced unit 9 or module 10 is between 25 and 200 kilo Newtons per metre circumference. The number of channels, the width or diameter of the reinforcement and the characteristics of the reinforcement can be adjusted to produce this tensile strength.

The fibres making up the reinforcement are made of tough rather than brittle material and have significant elongation at break (minimum 5%, ideally over 20%). This elongation performance may be inherent in the nature of the fibre itself, e.g. PE.PP Nylon, polycarbonate PET PE/PP, copolymers or imparted by twisting the fibres, e.g. "Kelvar" (RTM).

A material suitable for the reinforcement is the mesh system in the "Sympaforce" range made by Synteen Technical Fibres Inc of Lancaster, S.C., USA and Synteen GmbH of Klettgau-Erzingen, Germany. This is a high tenacity PET mesh bonded and encapsulated in PVC "plastisol" paste. Meshes with weight and tensile strength biased in the axial direction are preferred, with grades of axial strength of 50–200 kN/m and transverse/circumferential strength of 25–100 kN/m being particularly suitable. The mesh nature achieves the advantageous intermittent mechanical locking, whilst plastic surface finish gives the desired, only poor adhesive bonding to the epoxy resin encapsulating mix.

It is advantageous if the reinforcement is intermittently locked into the resin mix rather than continuously bonded, to allow the essential elongation of the reinforcement at the fracture location to be accommodated over a greater length of reinforcement. Reinforcement in the form of mesh systems provide the intermittent locking whilst the surface finish on the reinforcement can be selected to limit continuous bonding.

In an alternative method instead of creating the open channels 13 longitudinal borings can be made in the units 9 near the exterior surface. The reinforcements 20 are inserted into the borings which need to penetrate at least one end face of the unit 9 and the borings are filled with resin as before.

What is claimed is:

1. A method of reinforcing a marine buoyancy unit designed to fit at least partially around a marine riser or pipeline, against separation into parts following fracture, said method comprising cutting slots or channels in an exterior surface of the unit, placing reinforcement material in the channels and filling the channels with a curable resin to embed the reinforcement material into the channels, such that the reinforcement material is intermittently locked into the resin rather than being continuously bonded so as to allow for elongation at a fracture location.

2. A method according to claim 1, wherein the reinforcement is in the form of individual strands of polymer.

3. A method according to claim 1, wherein the unit is of part-cylindrical shape such that a number of such units can be united to form a module surrounding part of the object and the slots or channels extend longitudinally of the unit.

4. A method according to claim 1, wherein a glass fibre mat is laid onto at least part of the exterior surface to overlie one or more of the slots or channels prior to the application of the resin and the mat is bonded onto the surface with the resin.

5. A method according to claim 1, wherein there are between two and five slots or channels in the unit.

6. A method according to claim 1, wherein the reinforcement is in the form of a web or strip of polymer.

7. A method according to claim 6, wherein the webs or strips are composed of mesh with a plurality of longitudinal bands and a plurality of transverse bands.

8. A method according to claim 7, wherein the longitudinal bands are wider than the transverse bands.

9. A method according to claim 1, wherein the unit has an exterior layer of high strength polymer and an interior made of syntactic foam.

10. A method according to claim 9, wherein the channels penetrate the external layer and extend into the syntactic foam.

11. A method according to claim 1, wherein the additional tensile strength of the unit after treatment is in the range 25–200 k Newtons per metre circumference.

12. A method of reinforcing a marine buoyancy unit designed to fit at least partially around a marine riser or pipeline, against separation into parts following fracture, said method comprising producing borings extending within the unit, placing reinforcement material in the borings and filling the borings with a curable resin to embed the reinforcement material into the borings, such that the reinforcement material is intermittently locked into the resin rather than being continuously bonded so as to allow for elongation at a fracture location.

13. A method according to claim 12, wherein the reinforcement is in the form of individual strands of polymer.

14. A method according to claim 12, wherein the unit is of part-cylindrical shape such that a number of such units can be united to form a module surrounding part of the object and the borings extend longitudinally of the unit.

15. A method according to claim 12, wherein the additional tensile strength of the unit after treatment is in the range 25–200 k Newtons per metre circumference.

16. A method according to claim 12, wherein the unit has an exterior layer of high strength polymer and an interior made of syntactic foam.

17. A method according to claim 12, wherein the reinforcement is in the form of a web or strip of polymer.

18. A method according to claim 17, wherein the webs or strips are composed of mesh with a plurality of longitudinal bands and a plurality of transverse bands.

19. A method according to claim 18, wherein the longitudinal bands are wider than the transverse bands.

20. A method of reinforcing a marine buoyancy unit against separation into parts following fracture, wherein the marine buoyancy unit is configured to fit at least partially around a marine riser or pipeline, said method comprising cutting slots or channels in an exterior surface of the unit, placing reinforcement material in the channels and filling the channels with a curable resin to embed the reinforcement material into the channels, the reinforcement material exhibiting elongation of more than 5% prior to breakage and being able to elongate at a fracture location.

21. A method according to claim 20, wherein the channels penetrate the external layer and extend into the syntactic foam.

22. A method according to claim 20, wherein there are between two and five slots or channels in the unit.

23. A method according to claim 20, wherein the reinforcement is in the form of a web or strip of polymer.

24. A method according to claim 20, wherein the reinforcement material exhibits elongation of more than 20% prior to breakage.

25. A method according to claim 20, wherein the unit has an exterior layer of high strength polymer and an interior made of syntactic foam.

26. A method of reinforcing a marine buoyancy unit against separation into parts following fracture, wherein the marine buoyancy unit is configured to fit at least partially around a marine riser or pipeline, said method comprising producing borings extending within the unit, placing reinforcement material in the borings and filling the borings with a curable resin to embed the reinforcement material into the borings, the reinforcement material exhibiting elongation of more than 5% prior to breakage and being able to elongate at a fracture location.

27. A method according to claim 26, wherein the reinforcement is in the form of a web or strip of polymer.

28. A method according to claim 26, wherein the unit has an exterior layer of high strength polymer and an interior made of syntactic foam.

29. A method according to claim 26, wherein the reinforcement material exhibits elongation of more than 20% prior to breakage.

* * * * *